US005165851A

United States Patent [19]

Kubo et al.

[11] Patent Number: 5,165,851

[45] Date of Patent: Nov. 24, 1992

[54] FUEL INJECTION PUMP

[75] Inventors: Kenichi Kubo; Hisashi Nakamura; Akira Kunishima; Fumitsugu Yoshizu, all of Saitama, Japan

[73] Assignee: Zexel Corporation, Tokyo, Japan

[21] Appl. No.: 687,248

[22] Filed: Apr. 18, 1991

[30] Foreign Application Priority Data

Apr. 20, 1990 [JP] Japan ..... 2-102890

[51] Int. Cl.[5] ..... F02M 41/12

[52] U.S. Cl. ..... 417/500; 123/449; 123/495

[58] Field of Search ..... 417/500, 289, 492; 123/449, 496, 495, 504

[56] References Cited

U.S. PATENT DOCUMENTS 4,652,221 3/1987 Kato et al. ..... 123/449 X
4,685,870 8/1987 Kato ..... 417/500

FOREIGN PATENT DOCUMENTS 182159 5/1986 European Pat. Off. .
243339 10/1987 European Pat. Off. .
304741 3/1989 European Pat. Off. .
2175053 11/1986 United Kingdom .

*Primary Examiner*—Leonard E. Smith

[57] ABSTRACT

There is disclosed an improved cam for a fuel injection pump. The cam has a mountain-like cam projection at its surface disposed in contact with a roller. The cam projection has a lift region extending from a leading end thereof to a peak thereof. At the lift region, the cam is lifted in response to the rotation of the cam, so that a plunger is moved to pressurize fuel in a pump chamber. The lift region has first, second and third angle portions arranged in this order from the leading end of the cam projection toward the peak of the cam projection. The first angle portion serves to increase a lift speed of the cam, and terminates in a position where the lift speed becomes the maximum. The second angle portion serves to lower the lift speed. The deceleration is greater at an initial section of the second angle portion than at a final portion of the second angle portion. The lift speed decreases with a greater deceleration at the third angle portion than at the final section of the second angle portion, and becomes zero at the peak of the cam projection.

6 Claims, 5 Drawing Sheets

FUEL INJECTION PUMP

BACKGROUND OF THE INVENTION

This invention relates to a fuel injection pump, and more particularly to an improved cam for use in a fuel injection pump of the distribution type.

As is well known, a fuel injection pump of the distribution type comprises a drive shaft and a cylinder which are mounted on a housing in coaxial relation to each other. One end portion of a plunger is received in the cylinder, and cooperates therewith to form a pump chamber. Within the housing, the other end of the plunger is disposed in opposed relation to one end of the drive shaft. The rotational movement of the drive shaft is converted by a cam mechanism into axial reciprocal movement and rotational movement of the plunger. Fuel in the pump chamber is pressurized by the advance stroke of the axial reciprocal movement of the plunger, and the fuel is drawn into the pump chamber by the return stroke of this reciprocal movement. Each time the fuel in the pump chamber is pressurized, the pump chamber is sequentially connected, through the rotation of the plunger, to a plurality of (for example, four) delivery valves, mounted on the housing, via a passage formed in the plunger. As a result, injection nozzles connected respectively to the delivery valves sequentially inject the fuel to cylinders of an engine, respectively.

The above cam mechanism comprises a plurality of (for example, four) rollers supported on the housing, a cam disposed in opposed relation to the rollers, and a spring urging the cam toward the rollers. The cam is connected to the one end of the drive shaft in such a manner as to transmit the rotation of the drive shaft to the cam and also to allow the cam to move axially. The other end of the plunger is connected to the cam in such a manner as to transmit the rotation of the cam to the plunger and also to cause the plunger to move axially together with the cam.

The surface of the cam facing the rollers serves as a cam surface. A plurality of (for example, four) mountain-like cam projections of identical shape are formed on the cam surface at equal intervals in the direction of the periphery of the cam. During the rotation of the cam, when the roller is disposed at a lift region extending from a leading end of the cam projection to a peak thereof, the cam is lifted in a direction away from the roller to move or advance the plunger. When the roller is disposed at a descend region extending from the peak of the cam projection to a trailing end thereof, the cam descend in a direction toward the roller to return the plunger.

The design of the cam projection must meet the following requirements:

(a) The fuel must be injected under high pressure. With this high-pressure injection, the fuel injection rate (i.e., the amount of injection of the fuel per unit time) can be increased, thereby reducing the amount of production of Nox and smoke. The high-pressure injection can be achieved by increasing the maximum speed of advance stroke of the plunger, that is, the maximum lift speed of the cam.

(b) The maximum lift amount of the cam must be limited. If the maximum lift amount is increased, the resilient deformation of the spring urging the cam is increased, which results in a shortened lifetime of the spring.

(c) The pressure of contact between the cam surface and the roller must be kept to a low level. By doing so, the lifetime of the cam surface can be prolonged.

Japanese Laid-Open (Kokai) Utility Model Application No. 95570/89 shows in FIG. 5 the relation between a lift speed of a cam and a cam angle. A lift region of a mountain-like cam projection has a first angle portion where the lift speed of the cam linearly increases relatively abruptly, a second angle portion where the lift speed linearly decreases relatively gently, and a third angle portion where the lift speed linearly decreases relatively abruptly. The maximum value of the lift speed appears at the boundary between the first and second angle portions. The first angle portion has a concavely curved surface, and each of the second and third angle portions has a convexly curved surface.

In the above prior publication, when it is intended to meet the requirement (a) quite satisfactorily, the other requirements (b) and (c) fail to be met. Namely, if the maximum lift speed is made higher than that shown in FIG. 5 of the above prior publication, the lift speed at the second angle portion is increased, and hence the maximum lift amount which is the integral value of the lift speed is increased, so that the requirement (b) fails to be met.

In view of the above, if the maximum lift speed is made higher than that shown in FIG. 5 of the above prior publication, and at the same time the degree of decrease of the lift speed (i.e., the deceleration) at the second angle portion is made greater, then the maximum lift amount can be controlled to an acceptable level. In this case, however, the requirement (c) can not be met, because if the deceleration is increased, the radius of curvature of the second angle portion is decreased, so that the area of contact between the roller and the second angle portion is decreased. As a result, the pressure of contact between the second angle portion and the roller which is produced by the resilient force of the spring and the pressure in the pump chamber increases, which results in a shortened lifetime of the second angle portion.

SUMMARY OF THE INVENTION

It is therefore an object of this invention to provide a fuel injection pump which ensures prolonged lifetime of a cam and a spring, and can increase the maximum lift speed of the cam, thereby achieving a low pollution.

According to the present invention, there is provided a fuel injection pump comprising:

(a) a housing;

(b) a drive shaft supported on the housing;

(c) cylinder means mounted on the housing in coaxial relation to the drive shaft;

(d) a plunger having one end portion received in the cylinder means, the other end of the plunger being disposed in opposed relation to one end of the drive shaft, and the plunger cooperating with the cylinder means to form a pump chamber; and (e) a cam mechanism for converting the rotation of the drive shaft to axial reciprocal movement and rotational movement of the plunger, the cam mechanism comprising a roller supported by the housing, a cam disposed in opposed relation to the roller, and a spring urging the cam toward the roller, the cam being connected to the one end of the drive shaft in such a manner as to transmit the rotation of the drive shaft to the cam and also to allow the cam to move axially, the other end of the plunger being connected to the cam in such a manner so as to transmit the rotation of the cam to the plunger and also to cause the plunger to move axially together with the cam, the cam having a cam surface in contact with the roller, a mountain-like cam projection being formed on the cam surface, the cam projection having a lift region extending from a leading end thereof to a peak thereof, and a descend region extending from the peak to a trailing end of the cam projection, the roller coming into contact with the cam projection at the leading end thereof during the rotation of the cam; when the roller is kept in contact with the lift region, the cam being lifted in a direction away from the roller to move the plunger away from the drive shaft to pressurize fuel in the pump chamber, the roller coming out of contact with the cam projection at the trailing end thereof during the rotation of the cam; and when the roller is kept in contact with the descend region, the cam descending in a direction toward the roller to move the plunger toward the drive shaft to draw the fuel into the pump chamber;

the lift region having:

(i) a first angle portion extending from the leading end of the cam projection where a lift speed of the cam is zero to a position where the lift speed is the maximum, the lift speed relatively abruptly increasing at the first angle portion;

(ii) a second angle portion extending from the first angle portion, the lift speed of the cam decreasing at the second angle portion, and the deceleration of the lift of the cam being greater at an initial section of the second angle portion than at a final section of the second angle portion; and (iii) a third angle portion extending from the second angle portion to the peak of the cam projection, the lift speed decreasing with a greater deceleration at the third angle portion than at the final section of the second angle portion, and becoming zero at the peak of the cam projection.

DESCRIPTION OF THE PREFERRED EMBODIMENTS OF THE INVENTION

Figure 1:
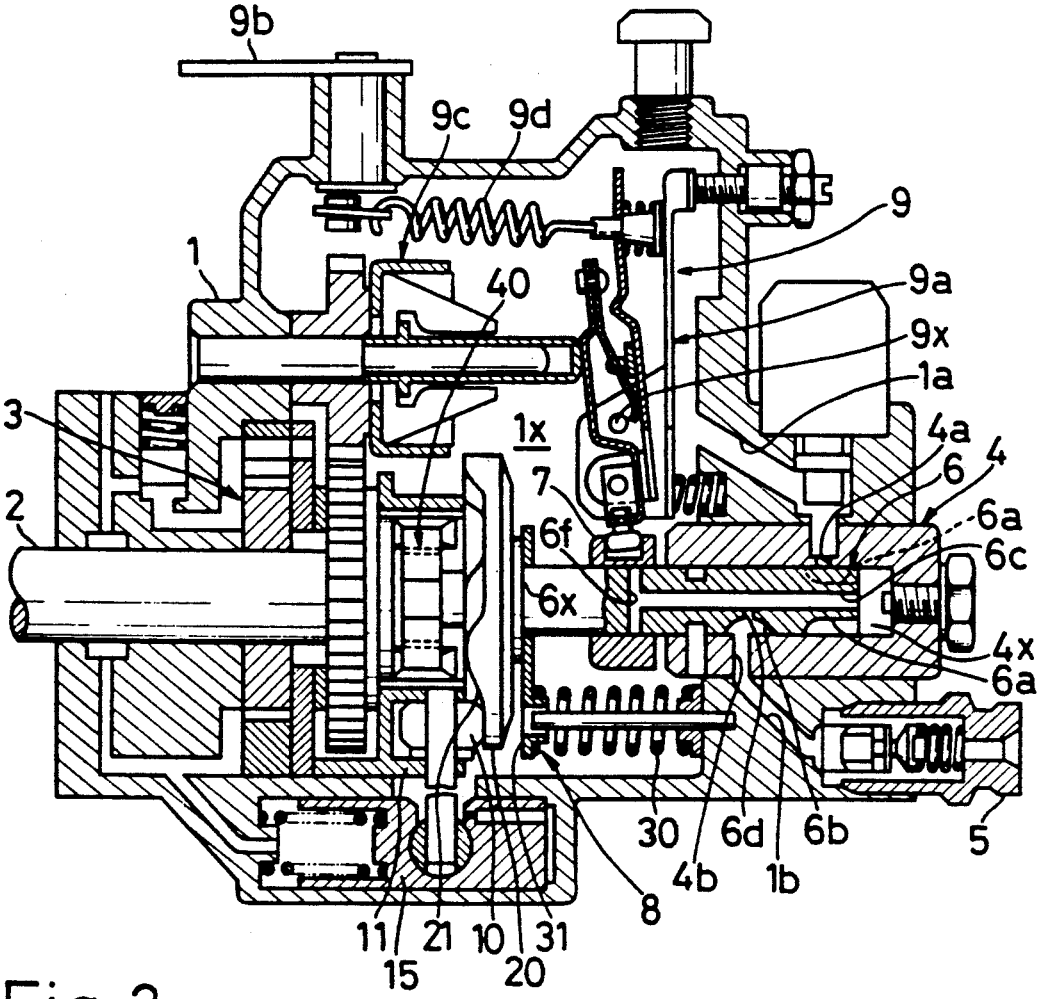
FIG. 1 is a cross-sectional view of a fuel injection pump of the distribution type provided in accordance with the present invention.

A preferred embodiment of the invention will now be described with reference to FIGS. 1 to 5. FIG. 1 shows a fuel injection pump of the distribution type. The basic construction of this fuel injection pump is well known, and therefore this pump will be explained briefly here. The fuel injection pump comprises a housing 1 having an internal space 1*x*. A drive shaft 2 is rotatably supported on the left portion (FIG. 1) of the housing 1. The left end portion of the drive shaft 2 is extended exteriorly of the housing 1 so as to receive the torque of an engine, and the right end of the drive shaft 2 is disposed in the internal space 1*x*. A fuel pump 3 is mounted on the left portion of the housing 1, and supplies fuel to the internal space 1*x* from the exterior by the rotation of the drive shaft 2.

A cylinder 4 is mounted on the right portion (FIG. 1) of the housing 1 in coaxial relation to the drive shaft 2. A plurality of (for example, four) delivery valves 5 are mounted on the housing 1, and are arranged around the cylinder 4. The delivery valves 5 are connected respectively via pipes to injection nozzles of the hole type (not shown) connected respectively to four cylinders of the engine. The four delivery valves 5 are connected respectively to four outlet ports 4*b* of the cylinder 4 via respective passages 1*b* formed in the housing 1.

A right end portion of a plunger 6 is received in the cylinder 4. The right end face of the plunger 6 cooperates with the cylinder 4 to form a pump chamber 4*x*. The left end of the plunger 6 is disposed in opposed relation to the right end of the drive shaft 2 within the internal space 1*x*.

The rotational movement of the drive shaft 2 is converted by a cam mechanism 8 (later described) into axial reciprocal movement and rotational movement of the plunger 6. When the plunger 6 moves in a left direction (FIG. 1) at the return stroke of its reciprocal movement, the fuel is drawn into the pump chamber 4*x*. Namely, the fuel stored in the internal space 1*x* is drawn into the pump chamber 4*x* via a passage 1*a* formed in the housing 1, an inlet port 4*a* of the cylinder 4 and one of four inlet slits 6*a* formed in the right end portion of the plunger 6.

When the plunger 6 moves in a right direction (FIG. 1) at the advance stroke of its reciprocal movement, the fuel in the pump chamber 4*x* is pressurized. At this advance stroke, an outlet slit 6*b* of the plunger 6 is selectively connected to one of the outlet ports 4*b* of the cylinder 4, and therefore the pressurized fuel in the pump chamber 4*x* is fed to the above-mentioned injection nozzle via an axial hole 6*c* of the plunger 6, a transverse hole 6*d* of the plunger 6, the outlet slit 6*b*, the outlet port 4*b* of the cylinder 4, the passage 1*b* of the housing 1 and the delivery valve 5. Then, the fuel is injected from this injection nozzle to the engine cylinder. At the advance stroke of the plunger 6, during the time when a cut-off port 6*f*, formed in the plunger 6 and communicating with the axial hole 6*c*, is closed by a control sleeve 7, the fuel injection continues. Then, when the cut-off port 6*f* is opened by the control sleeve 7, the pressurized fuel in the pump chamber 4*x* escapes to the internal space 1*x* via the axial hole 6*c* and the cut-off port 6*f*, so that the pressurizing of the fuel is terminated, thus finishing the fuel injection.

The position of the control sleeve 7 is controlled by a governor mechanism 9. The governor mechanism 9 comprises a lever assembly 9*a* pivotal about a pivot point 9*x*, a control lever 9*b* and a governor 9*c*. The control sleeve 7 is connected to the distal end of the lever assembly 9*a*. The control lever 9*b* is connected to the lever assembly 9*a* through a spring 9*d*. As the amount of pressing-down of an acceleration pedal increases, the control lever 9*b* increases the force for urging the lever assembly 9*a* to pivotally move in a counterclockwise direction, thereby moving the control sleeve 7 in the right direction. As a result, the termination of the fuel injection is delayed so as to increase the amount of fuel injection. As the rotational speed of the drive shaft 2 increases, the governor 9c increases the force for urging the lever assembly 9a to pivotally move in a clockwise direction, thereby moving the control sleeve in the left direction. As a result, the termination of the fuel injection is hastened to reduce the amount of fuel injection to thereby limit the engine speed.

Next, the above cam mechanism 8 will now be described in detail. The cam mechanism 8 comprises four rollers 10 (only one of which is shown in FIG. 1) provided in the internal space 1x of the housing 1, a disk-shaped cam 20 disposed in opposed relation to the rollers 10, and a plurality of springs 30 (only one of which is shown in FIG. 1) urging the cam 20 toward the rollers 10.

The rollers 10 are rotatably supported on a generally disk-shaped roller holder 11, and are spaced from one another at equal intervals in the circumferential direction of the roller holder 11. The roller holder 11 is angularly movably adjusted by a timer 15 mounted on the lower end portion of the housing. As is well known, the timer 15 determines the position of the roller holder 11 in accordance with the pressure in the internal space 1x, and hence determines the time of start of the fuel injection. Although the timer 15 is actually arranged perpendicularly to the sheet of FIG. 1, this timer is shown as disposed parallel to the sheet of FIG. 1 for illustration purposes.

The cam 20 is connected to the drive shaft 2 through a coupling 40 in such a manner as to transmit the rotation of the drive shaft 2 to the cam 20 and also to allow the cam 20 to move axially. The left end of the plunger 6 is connected to the cam 20 in such a manner as to transmit the rotation of the cam 20 to the plunger 6 and also to cause the plunger 6 to axially move together with the cam 20. More specifically, a flange 6x is formed on the left end of the plunger 6, and the flange 6x is connected to the cam 20 through a pin (not shown) so as to transmit the rotation of the cam 20 to the plunger 6. The springs 30 act between a spring retainer plate 31 and an inner surface of the housing 1, and the resilient force of the springs 30 is applied to the cam 20 via the spring retainer plate 31 and the flange 6x of the plunger 6. As a result, the cam 20 is held in contact with the rollers 11, and the plunger 6 is axially movable together with the cam 20.

Figure 2:
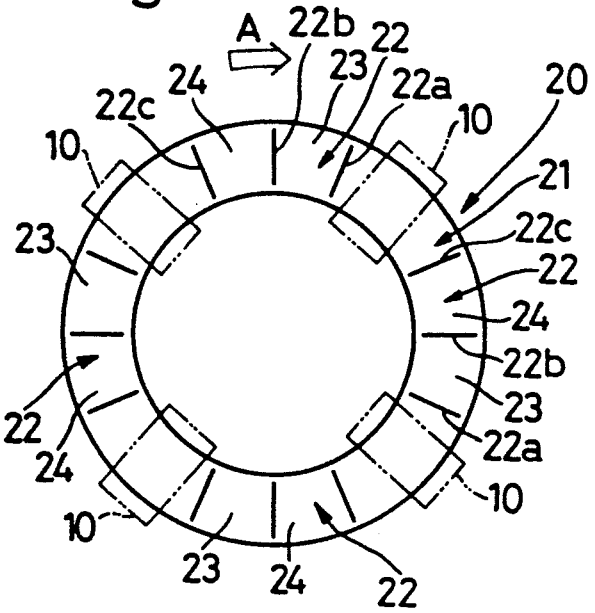
FIG. 2 is a front-elevational view of a cam used in the pump of FIG. 1.
Figure 3:
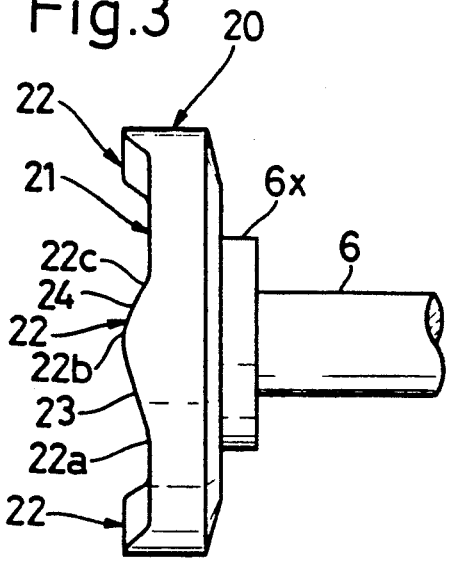
FIG. 3 is a side-elevational view of the cam.

As shown in FIGS. 2 and 3, part of that side or face of the cam 20 facing the rollers 10 serves as an annular cam surface 21. The cam 20 is rotatable relative to the rollers 11 in a direction of arrow A (FIG. 2). Four mountain-like cam projections 22 of an identical shape are formed on the cam surface 21 at equal intervals in the circumferential direction of the cam surface 21. Each of the cam projections 22 has a lift region 23 extending from a leading end 22a thereof to a peak 22b thereof, and a descend region 24 extending from the peak 22b to a trailing end 22c thereof. The roller 10 comes into contact with the cam projection 22 at the leading end 22a, and comes out of contact with the cam projection 22 at the trailing end 22c. During the time when the roller 10 is disposed on the lift region 23, the cam 20 is axially moved or lifted in a direction away from the rollers 10 to advance the plunger 6, thereby pressurizing the fuel in the pump chamber 4x. During the time when the roller 10 is disposed on the descend region 24, the cam 20 is axially moved or descends in a direction toward the rollers 10 to return the plunger 6, thereby drawing the fuel into the pump chamber 4x.

Figure 4:
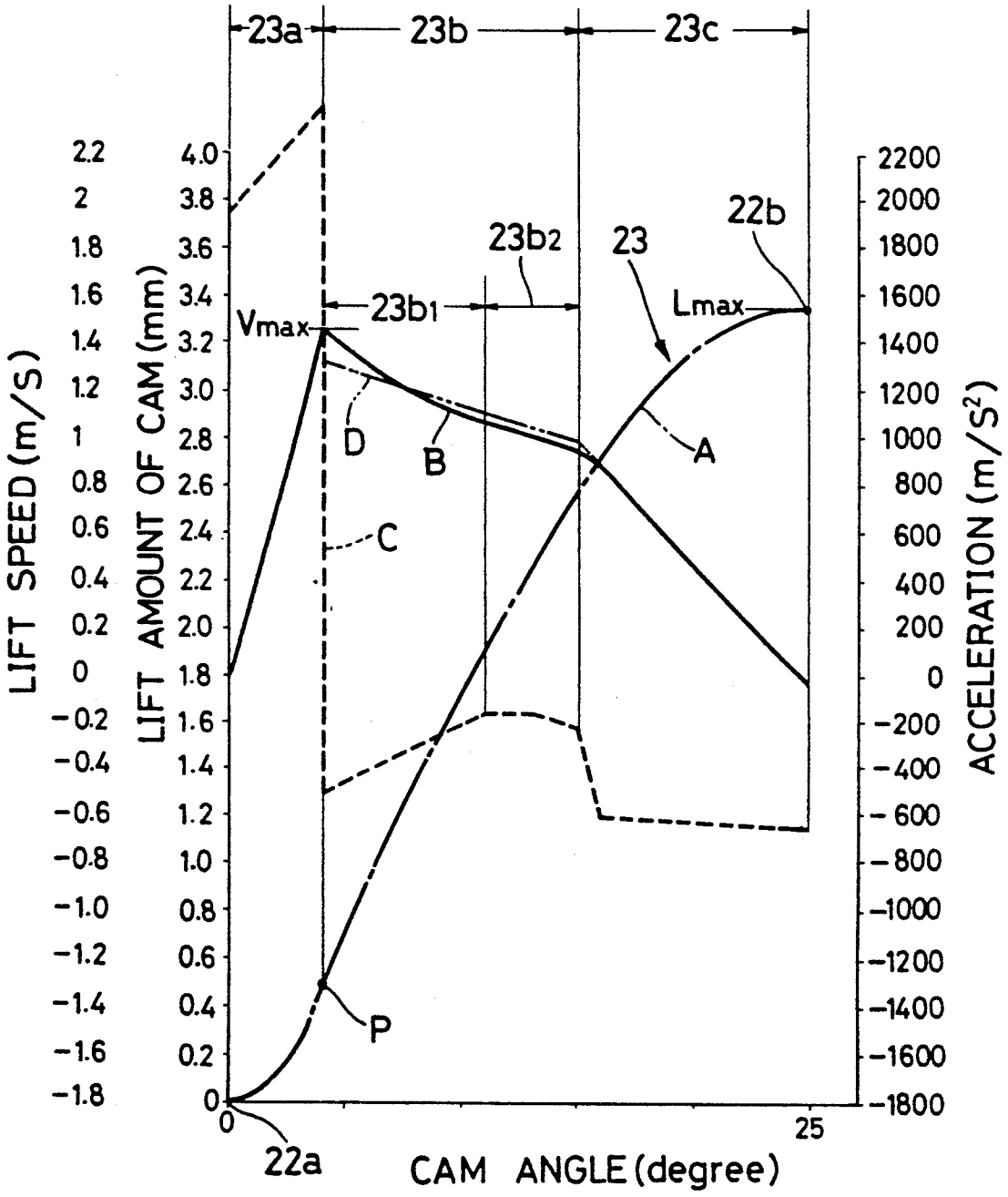
FIG. 4 is a graph showing a cam lift amount, a cam lift speed and the acceleration relative to a cam angle at a lift region of the cam.

In FIG. 4, a dot-and-dash line A represents the configuration of the lift region 23, that is, the amount of lift of the cam 20 relative to the cam angle, and a solid line B and a dotted line C represent the lift speed of the cam 20 and the acceleration of the cam 20 relative to the cam angle, respectively. In FIG. 4, the cam angle is zero at the leading end 22a of the cam projection 22. The values of the lift speed and the acceleration shown in FIG. 4 are obtained when the cam 20 rotates at its maximum speed. The lift region 23 has first, second and third angle portions 23a, 23b and 23c arranged in this order in the direction of increase of the cam angle. As will be appreciated from the following description, the first angle portion 23a has a concavely curved surface, and the second and third angle portions 23b and 23c have convexly curved surfaces, respectively.

The first angle portion 23a extends from the leading end 22a of the cam projection 22 (at which the lift speed of the cam 20 is zero) to a position P at which the lift speed is the maximum. The lift speed abruptly increases at the first angle portion 23a. In other words, the acceleration is large at the first angle portion 23a. In this embodiment, the acceleration also increases from the leading end 22a toward the position P.

The second angle portion 23b extends from the first angle portion 23a. At the boundary (the position P) between these two angle portions 23a and 23b, the cam 20 is changed from the accelerating condition into the decelerating condition. The cam 20 is decelerated throughout the second angle portion 23b. Here, it is important to note that the deceleration is greater at the initial section of the second angle portion 23b than at the final section thereof. More specifically, the second angle portion 23b has a first section 23b1 and a second section 23b2. At the first section 23b1, the deceleration is the maximum at the position P, and gradually decreases therefrom. The deceleration at the second section 23b2 is equal to the deceleration at the end of the first section 23b1, and is generally constant. Strictly speaking, the deceleration is constant at a first half of the second section 23b2, and slightly increases at a second half of the second section 23b2.

The second angle portion 23b serves as a control region. More specifically, during the time when the roller 10 is disposed on the second angle portion 23b, the cut-off port 6f is moved away from the control sleeve 7, thereby finishing the fuel injection. The fuel pressure in the pump chamber 4x becomes the maximum immediately before the termination of the fuel injection. In a high-load and high-speed operating condition of the engine, the fuel pressure in the pump chamber 4x becomes the maximum when the roller 10 reaches the final or second section 23b2 of the second angle portion 23b.

At the third angle portion 23c, the deceleration abruptly increases at an initial section thereof, and is maintained at a high level up to the peak 22b of the cam projection 22. In this embodiment, the deceleration at the third angle portion 23c is greater than the deceleration at the position P of the second angle portion 23b.

Effects obtained by the configuration of the cam projection 22 will now be described in detail. For comparison purposes, the relation between a cam angle and a lift speed of a conventional mountain-like cam projection is indicated by a dots-and-dash line D. The cam projection of the present invention provides the maximum lift speed Vmax greater than that of the conventional cam projection. Therefore, in the present invention, the injection pressure of the fuel can be increased, thereby increasing the fuel injection rate, so that the production of Nox and smoke can be kept to a low level. It has been confirmed through experiments that the illustrated cam of the present invention can effect the fuel injection at a higher pressure than the conventional (comparative) cam.

With the configuration of the cam projection 22 of the present invention, even if the maximum lift speed Vmax is increased as described above, the maximum lift amount Lmax can be kept to a level generally equal to that of the conventional cam projection. Referring to this reason, since the deceleration at and near the position P at the second angle portion 23*b* is large, the increase of the integral value of the lift speed (that is, the lift amount) at this portion can be kept to a low level, and this increase of the lift amount is canceled by the decrease of the lift amount which is obtained by lowering the lift speed at the intermediate and final sections of the second angle portion 23*b* to a level slightly lower than that of the conventional cam.

Further, even if the deceleration at the first section 23*b*1 of the second angle portion 23*b* is made greater than that of the conventional cam projection as described above, the lifetime of the cam surface 21 is not adversely affected. The reason for this will be described in detail below.

As described above, at the second angle portion 23*b*, the deceleration is the maximum at the position P, and gradually decreases as the cam angle increases. Therefore, the radius of curvature of the convexly curved surface of the second angle portion 23*b* is the smallest at the position P, and gradually increases as the cam angle increases. Therefore, the area of contact between the roller 10 and the cam surface 21 at the second angle portion 23*b* is the smallest at the position P, and gradually increases as the cam angle increases. On the other hand, as indicated by a solid line in FIG. 5, the fuel pressure in the pump chamber 4*x* at the maximum speed and maximum load of the engine is low at the initial section of the second angle portion 23*b*, and gradually increases with the increase of the cam angle, and reaches the maximum value at the final or second section 23*b*2 of the second angle portion 23*b*.

As described above, although the contact area is small in the vicinity of the position P (that is, at the initial section of the second angle portion 23*b*), the pressure of contact between the cam surface 21 and the roller 10 will not become excessive since the fuel pressure in the pump chamber 4*x* is low. The fuel pressure becomes high at the final section of the second angle portion 23*b*; however, since the area of contact between the cam surface 21 and the roller 10 is sufficiently large at this section, the contact pressure between the two will not become excessive. Therefore, damage to the cam surface can be prevented.

Figure 5:
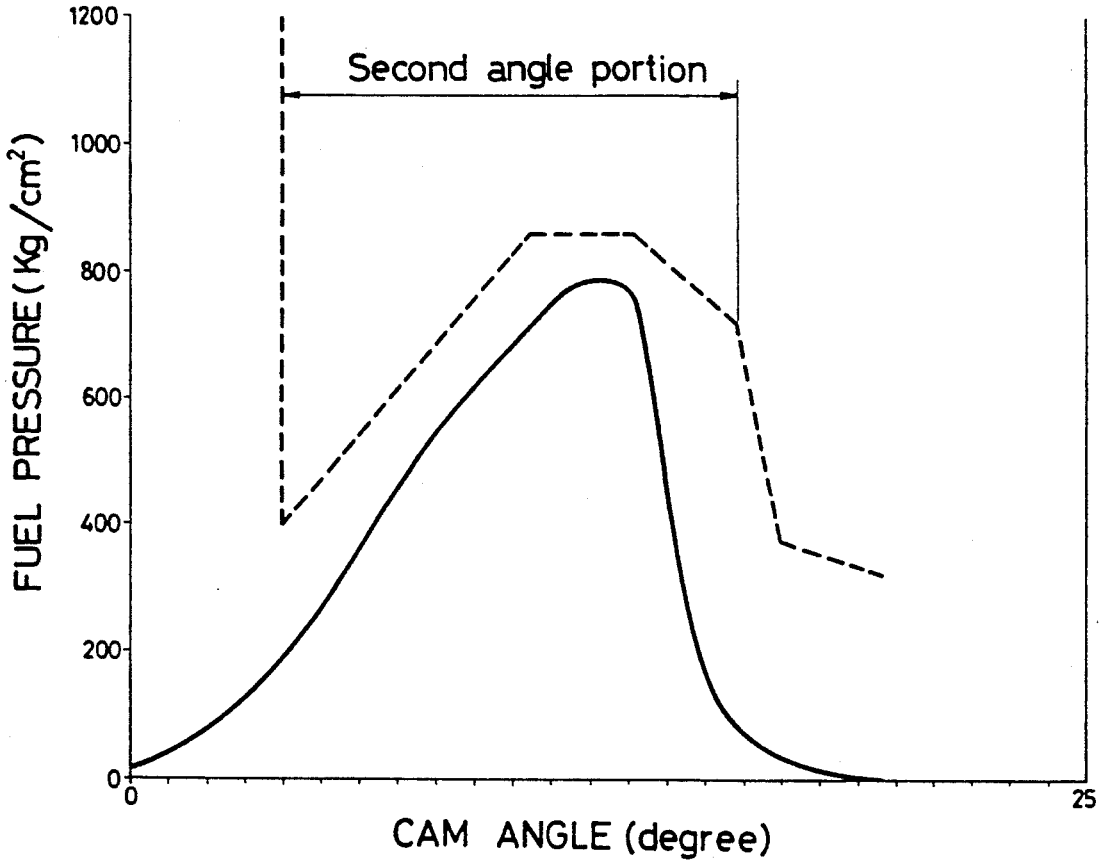
FIG. 5 is a graph showing the relation between the cam angle and the fuel pressure of a pump chamber as well as the maximum value of the fuel pressure allowed by the cam of FIG. 4.

Further, in this embodiment, the area of contact between the cam surface 21 and the roller 10 increases with the increase of the fuel pressure, and therefore the pressure of contact between the cam surface 21 and the roller 10 can be kept generally constant. Particularly when it is desired to obtain the maximum deceleration at the second angle portion 23*b* with the contact pressure set to an allowable limit, the configuration of the second angle portion 23*b* is determined in the following. First, an allowable fuel pressure higher than the fuel pressure indicated by the solid line in FIG. 5 is found (see a dotted line in FIG. 5). Then, the radius of curvature of the second angle portion 23*b* is so determined that the contact pressure can reach the allowable limit at the time when this allowable fuel pressure is applied.

The third angle portion 23*c* is not a control region. Namely, when the roller 10 is disposed on the third angle portion 23*c*, the cut-off port 6*f* has already been moved away from and opened by the control sleeve 7, so that the fuel pressure has decreased to an extremely low level or zero. Therefore, with respect to the third angle portion 23*c*, there is no need to consider the pressure of contact between the cam surface 21 and the roller 10, and it is only necessary to ensure that a cam jump will not occur at the third angle portion 23*c*.

As described above, in the present invention, in view of the fact that the fuel pressure at the initial section of the second angle portion 23*b* is different from the fuel pressure at the final section of the second angle portion 23*b*, the deceleration at the second angle portion 23*b* is changed in such a manner that the deceleration is made large at the initial section of the second angle portion 23*b*. By doing so, three requirements, that is, the increase of the maximum lift speed, the limitation of the maximum lift amount and the prolonged lifetime of the cam surface 21, can be met.

Figure 6:
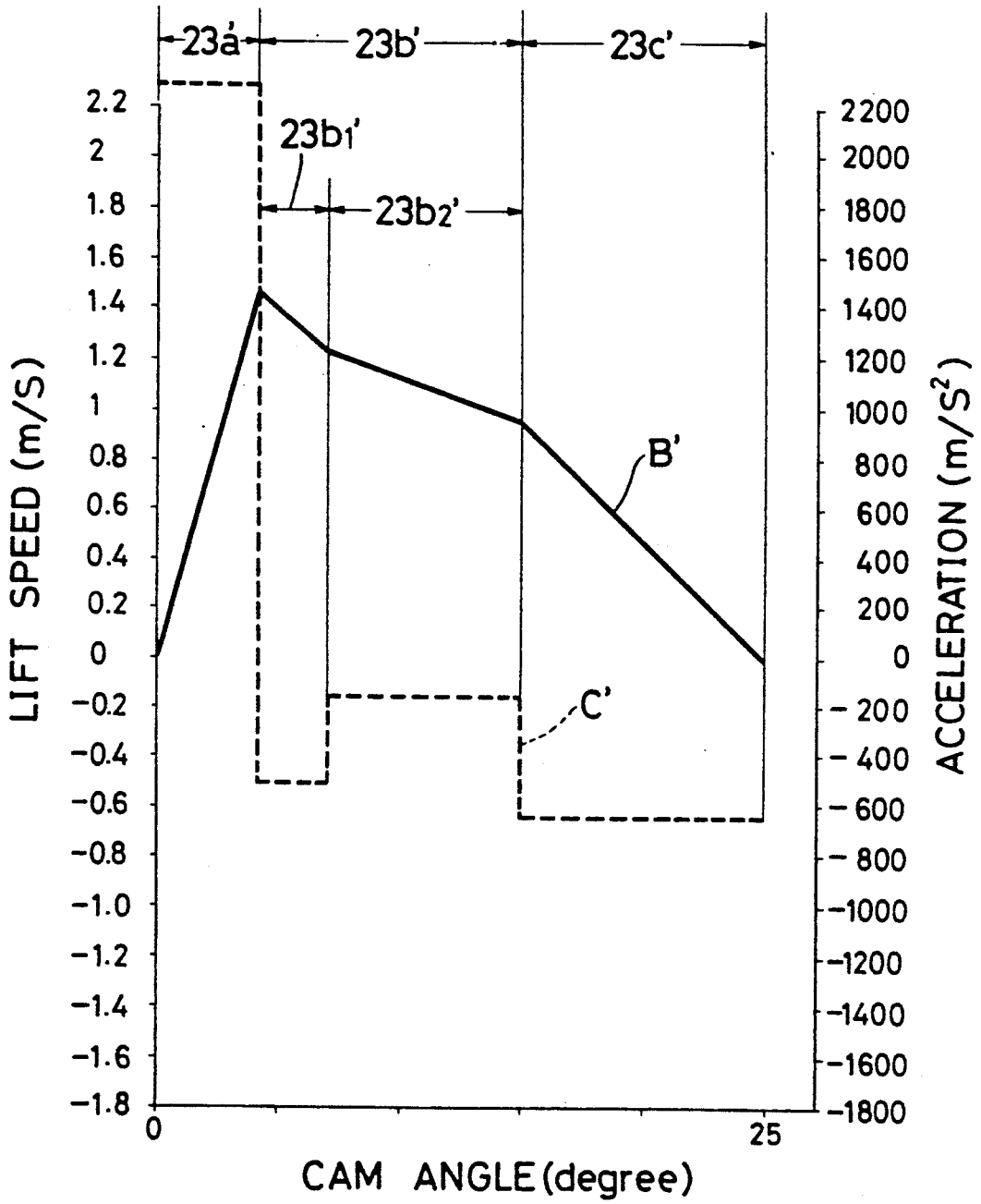
FIG. 6 is a graph showing a lift speed and the acceleration relative to a cam angle, obtained with a modified cam.

The present invention is not limited to the above embodiment, and modifications can be suitably made without departing from the scope of the invention. The lift speed and acceleration of a modified cam are indicated respectively by a solid line B' and a dotted line C' in FIG. 6. The deceleration is constant at a first section 23*b*1' and a second section 23*b*2' of a second angle portion 23*b*'. In other words, the lift speed decreases linearly. The deceleration at the first section 23*b*1' is greater than the deceleration at the second section 23*b*2'. In this embodiment, the acceleration at a first angle portion 23*a*' is constant, and the deceleration at a third angle portion 23*c*' is also constant. The deceleration at the second section 23*b*2' of the second angle portion 23*b*' may be zero.

Figure 7:
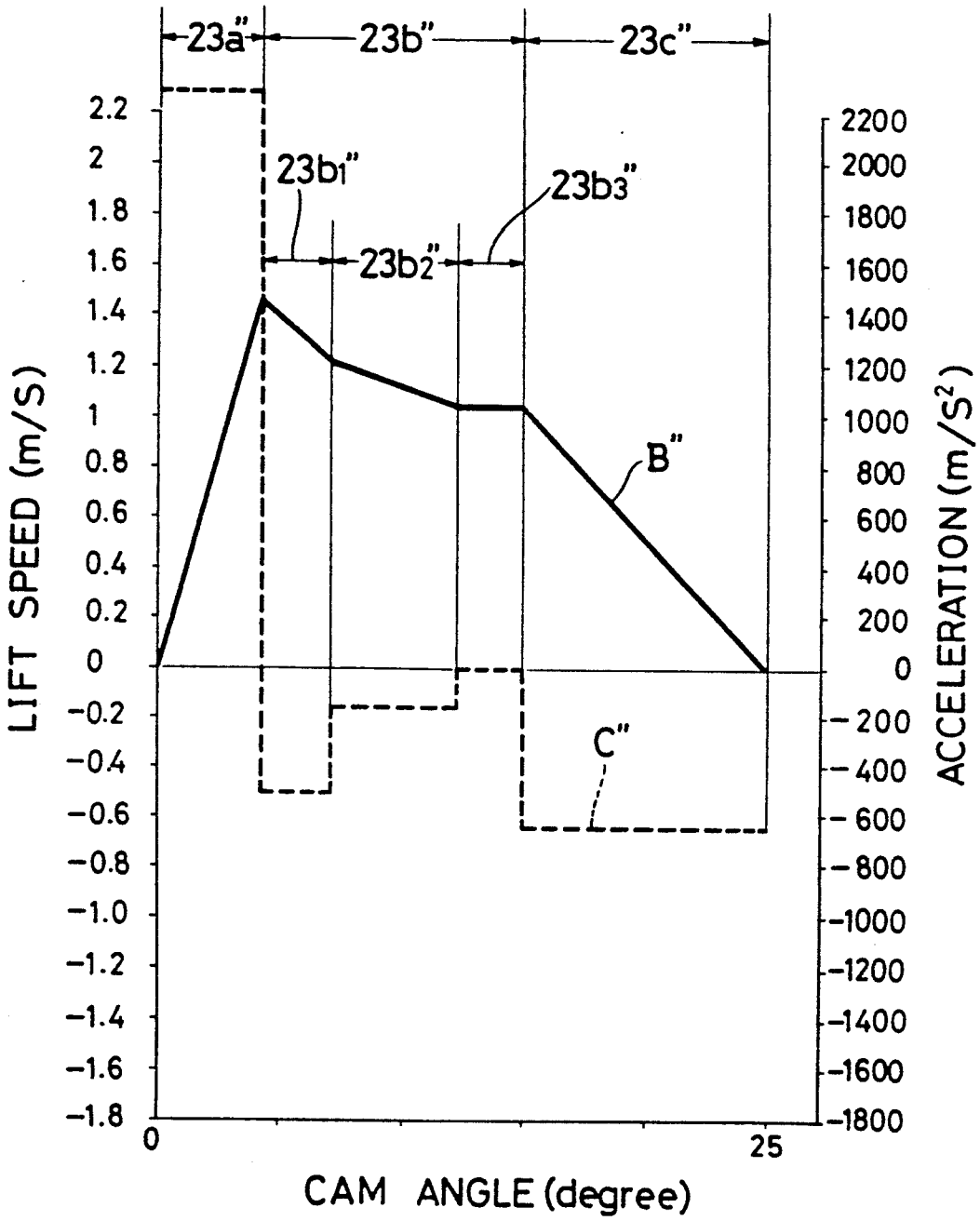
FIG. 7 is a graph similar to FIG. 6, but showing another modified cam.

The lift speed and acceleration of another modified cam are indicated respectively by a solid line B'' and a dotted line C'' in FIG. 7. A second angle portion 23*b*'' has a first section 23*b*1'', a second section 23*b*2'' and a third section 23*b*3'' arranged in this order in the direction of increase of the cam angle. The deceleration at each of these first to third sections is constant, and the deceleration at the second angle portion 23*b*'' decreases in a stepped manner in the order of arrangement of the first to third sections. At the third section 23*b*3'', the deceleration is zero, that is, the lift speed is constant. A first angle portion 23*a*'' and a third angle portion 23*c*'' are the same as those of FIG. 6, and therefore explanation thereof is omitted.

What is claimed is:

1. A fuel injection pump comprising:

(a) a housing;

(b) a drive shaft supported on said housing;

(c) cylinder means mounted on said housing in coaxial relation to said drive shaft;

(d) a plunger having one end portion received in said cylinder means, the other end of said plunger being disposed in opposed relation to one end of said drive shaft, and said plunger cooperating with said cylinder means to form a pump chamber; and (e) a cam mechanism for converting the rotation of said drive shaft to axial reciprocal movement and rotational movement of said plunger, said cam mechanism comprising a roller supported by said housing, a cam disposed in opposed relation to said roller, and a spring urging said cam toward said roller, said cam being connected to said one end of said drive shaft in such a manner as to transmit the rotation of said drive shaft to said cam and also to allow said cam to move axially, said other end of said plunger being connected to said cam in such a manner so as to transmit the rotation of said cam to said plunger and also to cause said plunger to move axially together with said cam, said cam having a cam surface in contact with said roller, a mountain-like cam projection being formed on said cam surface, said cam projection having a lift region extending from a leading end thereof to a peak thereof, and a descend region extending from said peak to a trailing end of said cam projection, said roller coming into contact with said cam projection at said leading end thereof during the rotation of said cam; when said roller is kept in contact with said lift region, said cam being lifted in a direction away from said roller to move said plunger away from said drive shaft to pressurize fuel in said pump chamber, said roller coming out of contact with said cam projection at said trailing end thereof during the rotation of said cam; and when said roller is kept in contact with said descend region, said cam descending in a direction toward said roller to move said plunger toward said drive shaft to draw the fuel into said pump chamber;

said lift region having:

(i) a first angle portion extending from said leading end of said cam projection where a lift speed of said cam is zero to a position where said lift speed is the maximum, said lift speed relatively abruptly increasing at said first angle portion;

(ii) a second angle portion extending from said first angle portion, said lift speed of said cam decreasing at said second angle portion, and the deceleration of the lift of said cam being greater at an initial section of said second angle portion than at a final section of said second angle portion; and (iii) a third angle portion extending from said second angle portion to said peak of said cam projection, said lift speed decreasing with a greater deceleration at said third angle portion than at said final section of said second angle portion, and becoming zero at said peak of said cam projection.

2. A fuel injection pump according to claim 1, in which said second angle portion has a section where said deceleration is the maximum at said position where said lift speed is the maximum, and is gradually decreasing toward said third angle portion.

3. A fuel injection pump according to claim 2, in which said second angle portion has a first section where said deceleration is decreasing gradually toward said third angle portion, and a second section where said deceleration is generally constant, said second section extending from said first section.

4. A fuel injection pump according to claim 1, in which said second angle portion has a plurality of sections, said deceleration being constant at each of said plurality of sections, and said deceleration decreasing in a stepped manner sequentially from a first one to a final one of said plurality of sections toward said third angle portion.

5. A fuel injection pump according to claim 1, in which said deceleration at said final section of said second angle portion is greater than zero.

6. A fuel injection pump according to claim 1, in which said deceleration at said final section of said second angle portion is zero.

* * * * *